US005766057A

United States Patent [19]

Maack

[11] Patent Number: 5,766,057

[45] Date of Patent: Jun. 16, 1998

[54] CENTERLESS GRINDING MACHINE

[75] Inventor: Horst E. Maack, Cincinnati, Ohio

[73] Assignee: Cincinnati Milacron Inc., Cincinnati, Ohio

[21] Appl. No.: 424,673

[22] Filed: Apr. 19, 1995

[51] Int. Cl.[6] ..... B24B 49/18

[52] U.S. Cl. ..... 451/21; 451/56; 451/51; 451/242; 451/194

[58] Field of Search ..... 451/21, 49, 56, 451/51, 242, 243, 244, 194

[56] References Cited

U.S. PATENT DOCUMENTS 2,322,619 6/1943 Ekholm ..... 51/103
2,834,159 5/1958 Hill ..... 51/103
4,083,151 4/1978 Jessup et al. ..... 51/103
4,570,386 2/1986 Unno et al. .

FOREIGN PATENT DOCUMENTS 2249264 4/1974 Germany ..... B25B 5/30

*Primary Examiner*—Eileen P. Morgan
*Attorney, Agent, or Firm*—Thomas M. Farrell

[57] ABSTRACT

Grinding and regulating wheels are carried on opposed feed slides on a machine base. A workrest is fixed to the base between the opposed wheels. Wheel dressers are mounted to cross-slides on the base, behind the wheels, independent of the feed slides. CNC dressing occurs through combined transverse motions of feed slide (with wheel) and cross slide (with dresser).

15 Claims, 2 Drawing Sheets

CENTERLESS GRINDING MACHINE

FIELD OF INVENTION

This invention relates to centerless grinders employing behind-the-wheel dressing devices.

BACKGROUND OF THE INVENTION

It is known in grinding machine arts to provide "behind-the-wheel" dressing units, i.e., where dressing is performed at a point on the wheel periphery away from (and usually diametrically opposed to) the workpiece contact point. In these applications, a wheel slide carries a wheel, for example, a grinding wheel or regulating wheel, the wheel slide being fed with respect to a workpiece. The wheel slide, in turn, carries a wheel dressing unit, which employs a wheel conditioning, or dressing apparatus, for example, a single point dressing nib, or a diamond impregnated dressing roll, since diamond seems to be the preferred dresser material. The wheel dressing unit includes a relatively stationary base which is mounted to the wheel slide, and a relatively movable diamond carrier is advanced along ways of the dressing unit base by means of a separate feed mechanism, usually comprising a motor and screw.

These prior art wheel dressing units tend to be complex, in that they require a discrete device for providing radial movement of the dressing diamond with respect to the grinding wheel, both when the diamond is dressing, and when the diamond is compensatingly-moved for wheel attrition during the grinding process. Prior art dressing units also usually involve a cross slide for traversing the diamond across the grinding wheel surface, i.e., the dressing diamond is moved with a component parallel to the rotary axis of the wheel to traverse the wheel width and generate a wheel profile during the conditioning process.

While conventional centerless grinders employ a fixed grinding wheelhead, it is known to provide a machine structure in which both the grinding wheel and regulating wheel move along the base, and in this regard, the following publications are of interest:

U.S. Pat. No. 2,322,619, of Ekholm, Jun. 22, 1943, teaches a centerless grinder with movable wheelheads; no dressing devices are shown.

U.S. Pat. No. 4,083,151, of Jessup et al., Apr. 11, 1978, teaches a centerless grinder with wheelheads movable along nonparallel axes; no dressing devices are shown.

German patent publication No. 2,249,264 teaches a centerless grinder with wheelheads movable along nonparallel axes, where the wheelheads have behind-the-wheel dressing units.

Another centerless grinding machine configuration is depicted in U.S. Pat. No. 2,834,159, of Hill, May 13, 1958, in which movable wheelheads are employed, but where the single-point diamond dressing nibs are mounted to the workrest. Here, in order to traverse the wheel face with the nib, the workrest is mounted to a slide which is movable in a direction parallel to the rotary axis of the grinding wheel; in other words, the workrest becomes a common dressing unit for both wheelheads. The dressing function takes place in "front" of the wheel (at the workpiece contact point), in the same way that table dressing is performed in a centertype grinder, when a dressing nib is affixed to the footstock of a sliding table. Drawbacks to this arrangement include potential loss of accuracy in the workrest blade location due to wear in the slide elements, a dresser support which is fairly weak in a direction radially of the wheel, and rather severe limitations in the size of the dresser which can be used.

Certain disadvantages in the prior art behind-the-wheel conditioning devices are obviated by the following invention.

SUMMARY OF THE INVENTION

It is, therefore, an object of the present invention to provide for behind-the-wheel dressing of both grinding and regulating wheels in a centerless grinding machine, wherein the dressing devices are not mounted to the wheel slides.

Another object of the present invention is to provide a simplified behind-the-wheel dressing unit for use in a centerless grinder whereby the radial component of movement between the grinding wheel and dressing device is effected solely by moving the wheel to be dressed along its feed slide axis.

Still another object of the invention is to provide a behind-the-wheel dressing device in which the dressing unit is mounted to the machine base and is provided with a dresser slideway oriented transversely to the wheel feed slide axis.

The invention is shown embodied in a centerless grinding machine, comprising:

- a base;
- a workrest on the base for supporting a workpiece of revolution;
- a grinding wheelslide and grinding wheel mounted on the base for sliding movement along a first feed axis, toward and away from one side of the workrest;
- a regulating wheel slide and regulating wheel mounted on the base for sliding movement along a second feed axis toward and away from an opposite side of the workrest;
- means for moving the grinding wheel slide and regulating wheel slide with respect to the workrest;
- a grinding wheel dresser slide and grinding wheel dresser mounted on the base behind the grinding wheel, independent of the grinding wheel slide;
- a regulating wheel dresser slide and regulating wheel dresser mounted on the base behind the regulating wheel, independent of the regulating wheelslide;

whereby predetermined movement of the grinding wheel along the first feed axis, away from the workrest, will bring about contact between the grinding wheel and the grinding wheel dresser, and whereby predetermined movement of the regulating wheel along the second feed axis, away from the workrest, will bring about contact between the regulating wheel and the regulating wheel dresser.

DESCRIPTION OF THE INVENTION

Figure 1:
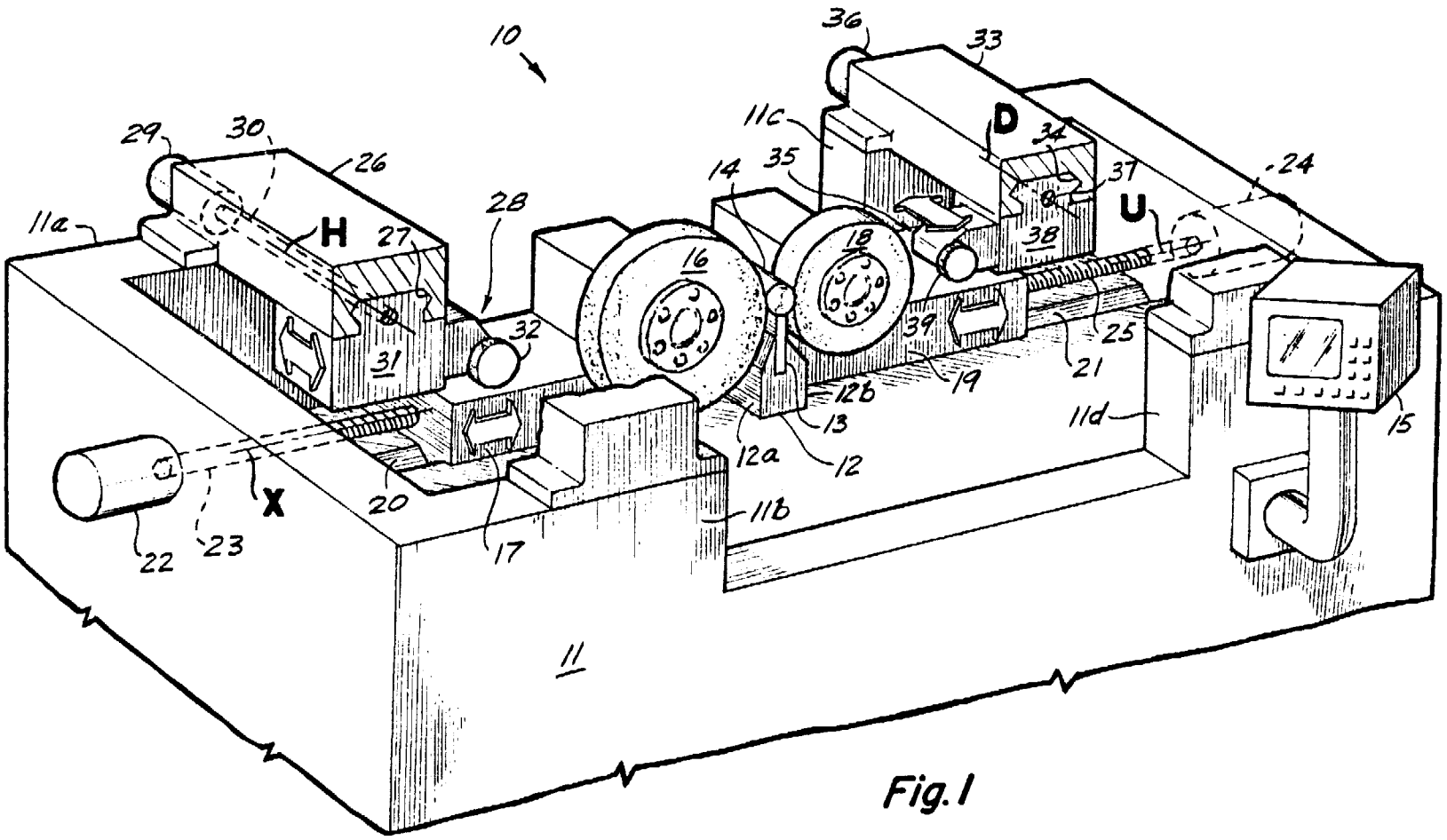
FIG. 1 is a perspective view of a centerless grinding machine having movable wheel heads and behind-the-wheel pressing units.

The drawing figures have been simplified for the purpose of clearly illustrating the principles of the invention; i.e., it is to be understood that ordinary details of construction, such as bearings, screws, motor drives, proper machine guarding, etc., are well within the ken of a machine tool designer.

With reference to FIG. 1, a centerless grinding machine 10 has a machine base 11, supporting a stationarily mounted workrest 12. The workrest 12 is conventional, and includes a work support blade 13 which helps to cradle a rotary workpiece 14 during the grinding process. The machine 10 also includes an electronic control 15 which is capable of managing multiple axes of movement; such control may be, for example, a CNC (computer numerical control) or PLC (programmable logic controller), well-known in machine tool arts, and will not be further described.

The grinding machine 10 employs a movable grinding wheel 16 which is rotatably supported by a wheelhead, or grinding wheel slide 17; the slide 17 is mounted on the base 11 for sliding movement along a first feed axis, "X", toward and away from one side 12*a* of the workrest 12, i.e., radially of the workpiece 14. In a fashion similar to that for supporting the grinding wheel 16, the regulating wheel 18 is rotatably supported by a wheelhead, or regulating wheel slide 19, which is mounted on the base 11 for sliding movement along a second feed axis, "U", toward and away from the opposite side 12*b* of the work rest 12, i.e., radially of the workpiece 14. The first and second feed axes "X", "U" are parallel in this case, but could be otherwise arranged. The two slides 17,19 are governed by suitable guideways 20,21 which may be of any form, but which are illustrated herein as simple V-ways.

The grinding wheel slide 17 is powered by a servo motor 22 and ballscrew assembly 23, mounted to the left side of the base 11, and the regulating wheel slide 19 is also powered by a servo motor 24 and ballscrew assembly 25, mounted to the right side of the base 11.

The left side of the base 11 has integral front and rear raised elements, or walls 11*a*,*b*, and a stiff bridge member 26, attached to the top of the walls 11*a*,*b*, spans the grinding wheel slide 17. The bridge member 26 has a slideway 27 which runs transversely to the grinding wheel slide feed axis "X", preferably at ninety degrees, and the slideway 27 supports a grinding wheel dresser unit 28 for movement along a first cross slide axis "H", across the wheel width. The bridge member 26 is provided with a servo motor 29 and ballscrew assembly 30 for driving the grinding wheel dresser unit 28 across the wheel 16. The grinding wheel dresser unit 28 is comprised of a slide 31 fitted to the bridge member slideway 27, and a wheel conditioning surface, or dresser 32. In this case, the grinding wheel dresser 32 is depicted as a diamond-impregnated wheel which is rotatably powered by motor means (not shown). It will be appreciated, though, that various wheel conditioning elements may likewise be supported on the grinding wheel dresser unit 28; for example, a single point diamond dressing nib.

The right side of the base 11 has integral front and rear support elements, or walls 11*c*,*d*, and a stiff bridge member 33, attached to the top of the walls 11*c*,*d*, spans the regulating wheel slide 19. The bridge member 33 has a slideway 34 which runs transversely to the regulating wheel slide feed axis "U", preferably at ninety degrees, and the slideway 34 supports a regulating wheel dresser unit 35 for movement along a second cross slide axis "D", across the wheel width. The bridge member 33 has a servo motor 36 and ballscrew assembly 37 for driving the regulating wheel dresser unit 35 across the wheel 18. The regulating wheel dresser unit 35 is comprised of a slide 38 fitted to the bridge member slideway 34, and a wheel conditioning surface, or dresser 39; in this case, the regulating wheel dresser 39 is depicted as a diamond-impregnated wheel which is powered by motor means (not shown). Location of the bridge members 26,33 behind the wheels 16,18 affords an opportunity for amply stiffening the dresser mounts.

To briefly summarize the principles of operation, the grinding wheel dresser slide 31 and grinding wheel dresser 32 are mounted to the base 11 independently of the grinding wheel slide 17, and the regulating wheel dresser slide 38 and regulating wheel dresser 39 are mounted to the base 11 independently of the regulating wheel slide 19. The machine 10 is provided with an electronic control 15 capable of managing multiple machine axes of movement. Looking at the grinding wheel side of the machine 10, the control 15 provides for grinding movement by powering the grinding wheel slide 17 to the right, along axis "X". When it is time to recondition the wheel 16, the grinding wheel slide 17 is moved to the left, and retracted from the workpiece 14 to come into contact with the wheel dresser 32, and the dresser 32 may be moved laterally across the wheel, along axis "H". Thus, wheel conditioning and profile generation comes about by coordinated movements along the feed slide axis "X" and cross slide axis "H". Control of the regulating wheel side of the machine 10 takes place in the same manner and, if desired, at the same time.

Figure 2:
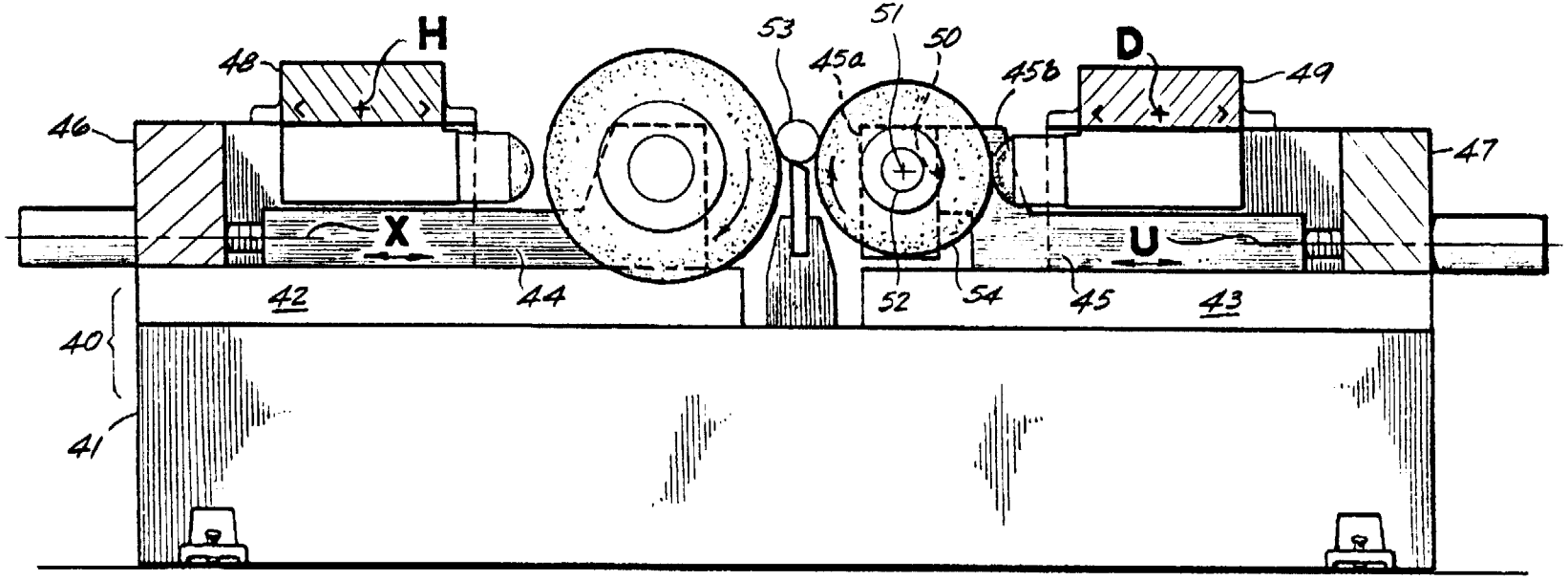
FIG. 2 is a front elevational view of an alternative embodiment of the centerless grinding machine of FIG. 1.

FIG. 2 is an alternative embodiment, essentially the same as FIG. 1, but where the machine base 40 is comprised of a lower portion 41 made, for example, of polymer concrete, or of granite pieces bonded within an epoxy resin matrix, and upper portions 42,43, made of cast iron and bolted to the lower portion 41, the upper portions 42,43 forming slideways for the grinding and regulating wheelheads 44,45. The supports 46,47 for the bridge members 48,49 are also separate elements, and are bolted to the respective upper portions 42,43 to form a unitary base structure. The regulating wheelhead 45 is comprised of a slide portion 45*a*, and a spindle housing 45*b*, joined at a swivel plane 50 which is parallel to the longitudinal axis 51 of the spindle 52, and which is normal to the second feed axis "U"; in other words, the swivel plane 50 runs into the plane of the paper as a viewer looks at FIG. 2. The spindle housing 45*b* can be swiveled on the swivel plane 50 to provide a small through-feed vector to the workpiece 53, derived from the tangential force exerted on the workpiece 53 by the regulating wheel 54, in a manner well-known in the centerless grinding arts.

Another alternative embodiment of the invention, not shown, would be to use a prior art formed crush-truing diamond roll, which is not moved axially of a grinding wheel, but is moved only radially with respect to the grinding wheel. In this case, the bridge member would not need a servo motor and feed screw; i.e., the crush roll dresser would simply be stationarily mounted to the bridge member. As in FIGS. 1 and 2, radial movement between the respective wheel and wheel dresser would be accomplished through use of the wheel feed slide axis, i.e., by retraction of the wheel from the workpiece and continued movement towards the dresser.

It will be appreciated that, while plain slides and slideways have been shown, a variety of anti-friction ways may be substituted into the assemblies. And, while electric servo motors and ballscrew assemblies are in the preferred embodiment, other actuators may be substituted therefor.

While the invention has been shown and described in connection with a preferred embodiment and alternative embodiments, it is not intended that the invention be so limited; rather, the invention extends to all such designs and modifications as come within the scope of the appended claims.

What is claimed is:

1. A centerless grinding machine, comprising:

a base;

a workrest on said base for supporting a workpiece of revolution;

a grinding wheel slide and grinding wheel mounted on said base for sliding movement along a first feed axis, toward and away from one side of said workrest;

a regulating wheel slide and regulating wheel mounted on said base for sliding movement along a second feed axis toward and away from an opposite side of said workrest;

means for moving said grinding wheel slide and regulating wheel slide with respect to said workrest;

a grinding wheel dresser slide and grinding wheel dresser mounted on said base behind the grinding wheel, independent of said grinding wheel slide; and a regulating wheel dresser slide and regulating wheel dresser mounted on said base behind the regulating wheel, independent of said regulating wheel slide;

whereby predetermined movement of said grinding wheel along said first feed axis, away from said workrest, will bring about contact between said grinding wheel and said grinding wheel dresser, and whereby predetermined movement of said regulating wheel along said second feed axis, away from said workrest, will bring about contact between said regulating wheel and said regulating wheel dresser.

2. A centerless grinding machine, comprising:

a base;

a workrest on said base for supporting a workpiece of revolution;

a grinding wheel slide and grinding wheel mounted on said base for sliding movement along a first feed axis, toward and away from one side of said workrest;

a regulating wheel slide and regulating wheel mounted on said base for sliding movement along a second feed axis toward and away from an opposite side of said workrest;

means for moving said grinding wheel slide and regulating wheel slide with respect to said workrest;

a grinding wheel dresser slide and grinding wheel dresser mounted on said base behind the grinding wheel, independent of said grinding wheel slide;

means for moving said grinding wheel dresser slide and grinding wheel dresser along a first cross-slide axis, transverse to said first feed axis;

a regulating wheel dresser slide and regulating wheel dresser mounted on said base behind the regulating wheel, independent of said regulating wheel slide; and means for moving said regulating wheel dresser slide and regulating wheel dresser along a second cross-slide axis, transverse to said second feed axis, whereby predetermined movement of said grinding wheel along said first feed axis, away from said workrest, will bring about contact between said grinding wheel and said grinding wheel dresser, and whereby predetermined movement of said regulating wheel along said second feed axis, away from said workrest, will bring about contact between said regulating wheel and said regulating wheel dresser.

3. The centerless grinding machine of claim 2, further comprising:

means for coordinating movement of said grinding wheel slide and said grinding wheel dresser slide, to thereby generate a grinding wheel profile, and coordinating movement of said regulating wheel slide and said regulating wheel dresser slide, to thereby generate a regulating wheel profile.

4. A method for dressing wheels of a centerless grinding machine, comprising the following steps:

providing a base;

providing a workrest on said base for supporting a workpiece of revolution;

mounting a grinding wheel slide and grinding wheel on said base for sliding movement along a first feed axis, toward and away from one side of said workrest;

mounting a regulating wheel slide and regulating wheel on said base for sliding movement along a second feed axis toward and away from an opposite side of said workrest;

mounting a grinding wheel dresser slide and grinding wheel dresser on said base behind the grinding wheel, independent of said grinding wheel slide;

mounting a regulating wheel dresser slide and regulating wheel dresser on said base behind the regulating wheel, independent of said regulating wheel slide;

moving said grinding wheel along said first feed axis, away from said workrest, to bring about contact between said grinding wheel and said grinding wheel dresser; and moving said regulating wheel along said second feed axis, away from said workrest, to bring about contact between said regulating wheel and said regulating wheel dresser.

5. The wheel dressing method of claim 4, further comprising the step of providing means for moving at least one of said grinding wheel dresser and said regulating wheel dresser along a cross-slide axis, transverse to said first feed axis.

6. A centerless grinding machine, comprising:

a base;

a workrest on said base for supporting a workpiece of revolution;

a grinding wheel, rotatably mounted on said base at one side of said workrest;

a regulating wheel slide and regulating wheel mounted on said base for sliding movement along a feed axis toward and away from an opposite side of said workrest;

means for moving said regulating wheel slide with respect to said workrest;

a regulating wheel dresser mounted on said base behind the regulating wheel, independent of said regulating wheel slide;

whereby predetermined movement of said regulating wheel along said feed axis, away from said workrest, will bring about contact between said regulating wheel and said regulating wheel dresser.

7. A centerless grinding machine in accordance with claim 6, further comprising:

means for moving said regulating wheel dresser along a cross-slide axis, transverse to said feed axis.

8. A centerless grinding machine in accordance with claim 7, further comprising:

means for coordinating movement of said regulating wheel slide along said feed axis and said regulating wheel dresser along said cross-slide axis, to thereby generate a regulating wheel profile.

9. A centerless grinding machine, comprising:

a base;

a workrest on said base for supporting a workpiece of revolution;

a regulating wheel, rotatably mounted on said base at one side of said workrest;

a grinding wheel slide and grinding wheel mounted on said base for sliding movement along a feed axis toward and away from an opposite side of said workrest;

means for moving said grinding wheel slide with respect to said workrest;

a grinding wheel dresser mounted on said base behind the grinding wheel, independent of said grinding wheel slide;

whereby predetermined movement of said grinding wheel along said feed axis, away from said workrest, will bring about contact between said grinding wheel and said grinding wheel dresser.

10. A centerless grinding machine in accordance with claim 9, further comprising:

means for moving said grinding wheel dresser along a cross-slide axis, transverse to said feed axis.

11. A centerless grinding machine in accordance with claim 10, further comprising:

means for coordinating movement of said grinding wheel slide along said feed axis and said grinding wheel dresser along said cross-slide axis, to thereby generate a grinding wheel profile.

12. A method for dressing a wheel of a centerless grinding machine, comprising the following steps:

providing a base;

providing a workrest on said base for supporting a workpiece of revolution;

mounting a grinding wheel on said base at one side of said workrest;

mounting a regulating wheel slide and regulating wheel on said base for sliding movement along a feed axis toward and away from an opposite side of said workrest;

mounting a regulating wheel dresser on said base behind the regulating wheel, independent of said regulating wheel slide; and moving said regulating wheel along said feed axis, away from said workrest, to bring about contact between said regulating wheel and said regulating wheel dresser.

13. The wheel dressing method of claim 12, further comprising the following step:

providing means for moving said regulating wheel dresser along a cross-slide axis, transverse to said feed axis.

14. A method for dressing a wheel of a centerless grinding machine, comprising the following steps:

providing a base;

providing a workrest on said base for supporting a workpiece of revolution;

mounting a regulating wheel on said base at one side of said workrest;

mounting a grinding wheel slide and grinding wheel on said base for sliding movement along a feed axis toward and away from an opposite side of said workrest;

mounting a grinding wheel dresser on said base behind the grinding wheel, independent of said grinding wheel slide; and moving said grinding wheel along said feed axis, away from said workrest, to bring about contact between said grinding wheel and said grinding wheel dresser.

15. The wheel dressing method of claim 14, further comprising the following step:

providing means for moving said grinding wheel dresser along a cross-slide axis, transverse to said feed axis.

* * * * *